United States Patent [19]

Sörensen

[11] 4,331,246

[45] May 25, 1982

[54] CONTAINER

[75] Inventor: Erling Sörensen, Odense NV, Denmark

[73] Assignee: PLM AB, Malmo, Sweden

[21] Appl. No.: 145,682

[22] Filed: May 1, 1980

[30] Foreign Application Priority Data

May 11, 1979 [SE] Sweden ..... 7904153

[51] Int. Cl.[3] ..... B65D 23/00

[52] U.S. Cl. ..... 215/1 C; 215/12 R; 215/100 R; 220/69

[58] Field of Search ..... 220/69; 215/1 C, 12 R, 215/100 R; 248/346

[56] References Cited

U.S. PATENT DOCUMENTS

| | | | |
|---|---|---|---|
| 3,409,167 | 11/1969 | Blanchard | 220/66 |
| 3,482,724 | 12/1969 | Heaton | 215/12 R X |
| 3,726,429 | 4/1973 | Doughty | 220/69 X |
| 3,927,782 | 12/1975 | Edwards | 215/1 C X |
| 4,082,200 | 4/1978 | Guest . | |
| 4,138,026 | 2/1979 | Conklin . | |
| 4,174,782 | 11/1979 | Obsomer | 215/1 C |

FOREIGN PATENT DOCUMENTS

| | | |
|---|---|---|
| 2351020 | 12/1977 | France . |
| 7605265-3 | 5/1976 | Sweden . |

*Primary Examiner*—Allan N. Shoap

*Attorney, Agent, or Firm*—Hane, Roberts, Spiecens & Cohen

[57] ABSTRACT

A container comprising a container body made of plastic material, with a convex bottom section, and a stand of plastic material, supporting the container body. The central zone of the stand is secured, preferably by welding, to the central zone of the convex bottom section of the container body. The stand has a conical collar surrounding the lower part of the container body. The bottom edge zone of the collar is shaped into an annular support surface, whereas its top edge zone engages into at least one annular shoulder in the container body. After fixing has been carried out in the central zone, the top edge zone is kept in contact with the annular shoulder of the container body by the elasticity of the plastic wall of the stand.

9 Claims, 3 Drawing Figures

CONTAINER

FIELD OF THE INVENTION

The invention relates to a container consisting of a container body made of a plastic material and with a convex bottom section, and a stand made of plastic material for supporting the container body, the central zone of the stand being secured, preferably by welding, to the central zone of the convex bottom section, and outwards being in the shape of a conical collar which forms a surface surrounding and supporting the container body. The bottom edge zone of the collar is shaped as an annular support surface, whereas the top edge zone is in contact with at least one annular shoulder in the container body. After fixing has been carried out in the central zone, the top edge zone is kept in contact with the annular shoulder, due to the elastic properties of the plastic wall of the stand.

BACKGROUND

A similar container is described in Swedish patent application No. 7605265-3. However, when welding the joint between the container body and the stand, a disadvantage is that the contact force during welding must be very high and that the elastic properties of the stand are too irregular to ensure a constantly uniform contact force against the shoulder on the container body. In practice, the known stand also has the disadvantage that the permissible height of drop in the event of an inadvertent fall in conjunction with the transport of the container is insufficient. The deformations which occur in the event of a fall permanently affect the stability, since the deformed areas do not resume their original shapes.

SUMMARY OF THE INVENTION

An object of the invention is to overcome these disadvantages and, by appropriate shaping of the stand, to achieve higher stability and greater security against permanent deformation in the event of an accidental fall.

This is achieved by providing the wall of the bottom surface of the stand with at least one elastic indentation running concentrically around the container axis, in the area between the bottom edge of the conical collar and the central zone reserved for welding, the edge being in the support plane and the central zone slightly above this plane. The indentation is at a distance "a" in relation to the nearest adjacent surface of the container, and this surface is adjusted to suit the weight of the container when full. By these measures, the central zones of the container and the stand, which are jointed by welding, can move axially as well as radially in relation to the conical collar as well as in relation to the annular support surface, the selected distance "a" thus normally preventing contact between the container body, when deformed by inertia forces, and the adjacent surface of the indentation. By this means, the preloading applied during welding to keep the stand in contact with the container body will also be maintained after the container body begins to exert a one-sided load on the elastic indentation in conjunction with an abnormal shock load. On the other hand, axially oriented shocks which achieve symmetrically uniform expansion of the container body in a radial direction cannot have detrimental effects, since the welded central parts move in the opposite direction, which counteracts weakening of the engagement as well as reduction in the stability. This gives rise to a surprising combination effect due to the welding, the distance "a" and the elastic indentation. In addition, at high shock loads, the elastic properties of the stand also cause any deformations occuring to revert to their original shape.

In a further aspect of the invention, the central zone of the stand has a diameter of about 25% of the container body diameter and the zone for the elastic indentation has an outside diameter of about 90% of the container body diameter. Due to this sizing, the central zone is kept appropriately small, whereas the diameter of the annular support surface has proved to be optimally large. These measures contribute to the high stability which is the aim of the invention.

Moreover, it is contemplated that the elastic indentation will comprise two conical surfaces at an angle of about 90° in relation to each other and at an angle of about 45° to the scope of the container axis. Although the invention includes different shapes of the elastic indentation, the described configuration has proved to have the most appropriate shape with respect to the conceivable deformations, since it allows for relative movements of the central zone, in an axial as well as a radial direction.

In a further aspect of the invention, at least one additional concentric elastic indentation is provided on the inside of the first elastic indentation in a direction towards the central zone, and the outer radial limit of this second indentation is at a distance "b" from the support plane. This has been found to provide an appropriate solution to the problem of increasing the elastic zone, while taking into account the free space available between the support plane and the container body.

Finally, it is envisaged that the conical collar of the stand starts with a slight taper of about 0.5° in the vicinity of the annular shoulder of the container body and, after the shoulder, the slope changes to about 3.5°.

This arrangement offers, on the one hand, improved contact between the container body and the stand in the vicinity of the annular shoulder and, on the other hand, a stiffer joint between the annular support surface and the adjacent elastic indentation. The stability is increased as all shocks applied transversely to the container axis are transferred better to the elastic zone of the stand.

In summary, experiments carried out show that a configuration of the stand in accordance with the invention increases the attainable height of drop by 280% as compared to that attainable by means of the known design. Due to the elastic resumption of the original shape, the large deformations which may occur during the transport and handling, even of filled container's no longer cause any reduction in the stability. The material distribution in the stand, with a material concentration in the annular support surface of the stand and elastic indentations, also has a positive influence on the stability and security against overturning.

DETAILED DESCRIPTION

Figure 1:
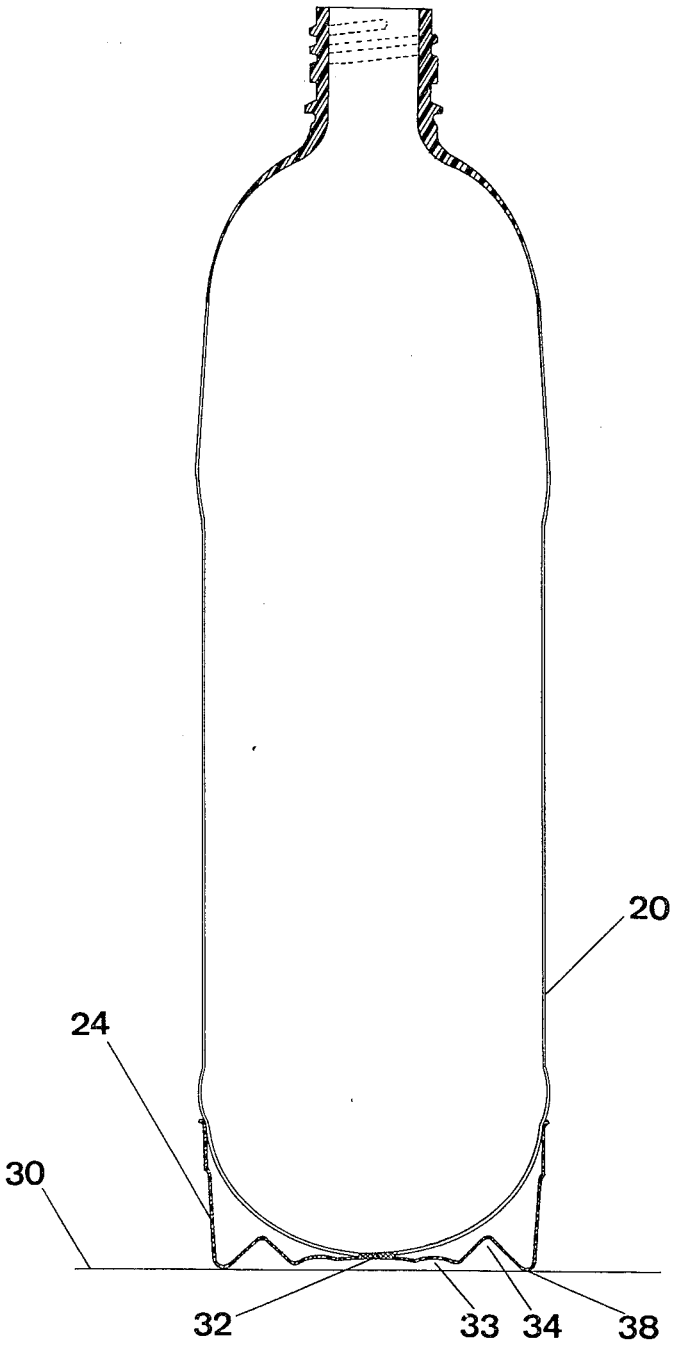
FIG. 1 is a cross-section through a container showing the container body and stand.
Figure 2:
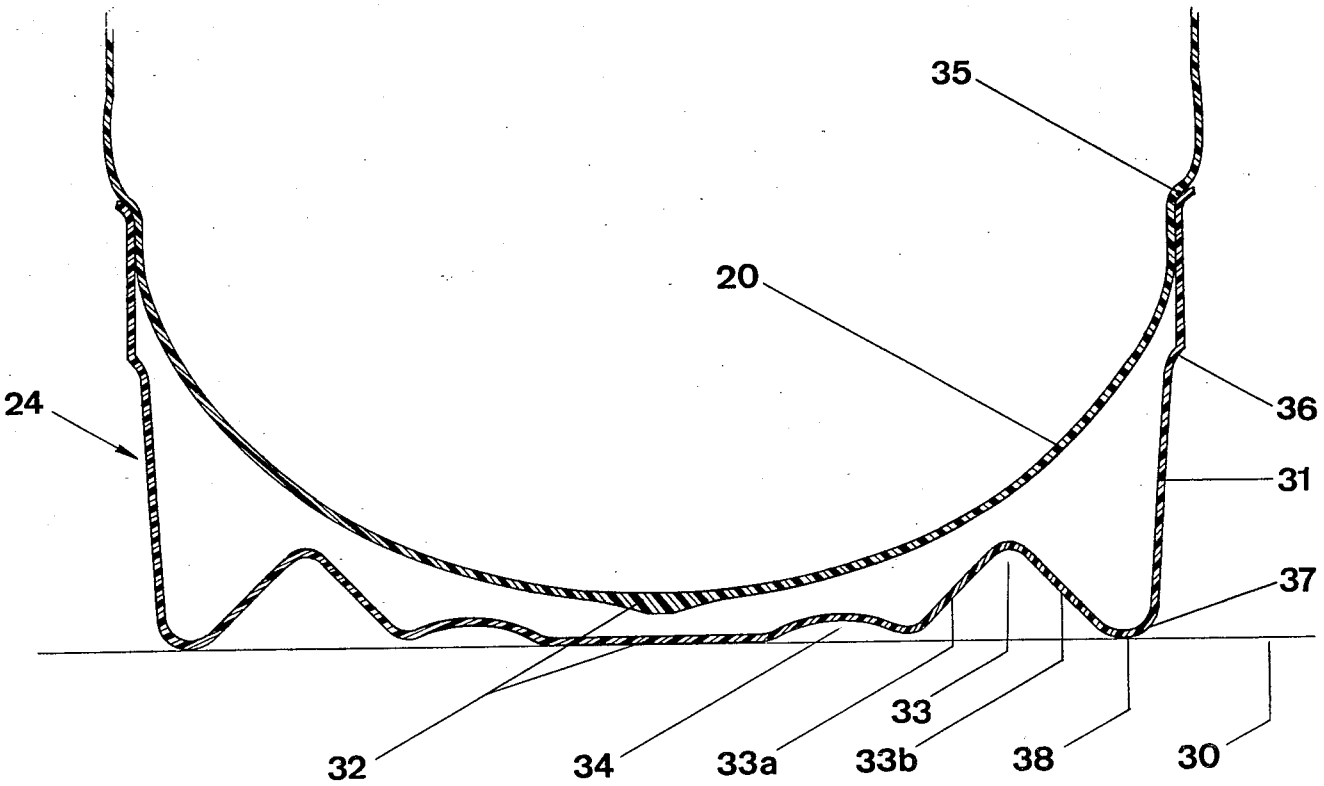
FIG. 2 is an enlarged cross-section through the stand and the bottom of the container body before welding and applying the welding pressure.
Figure 3:
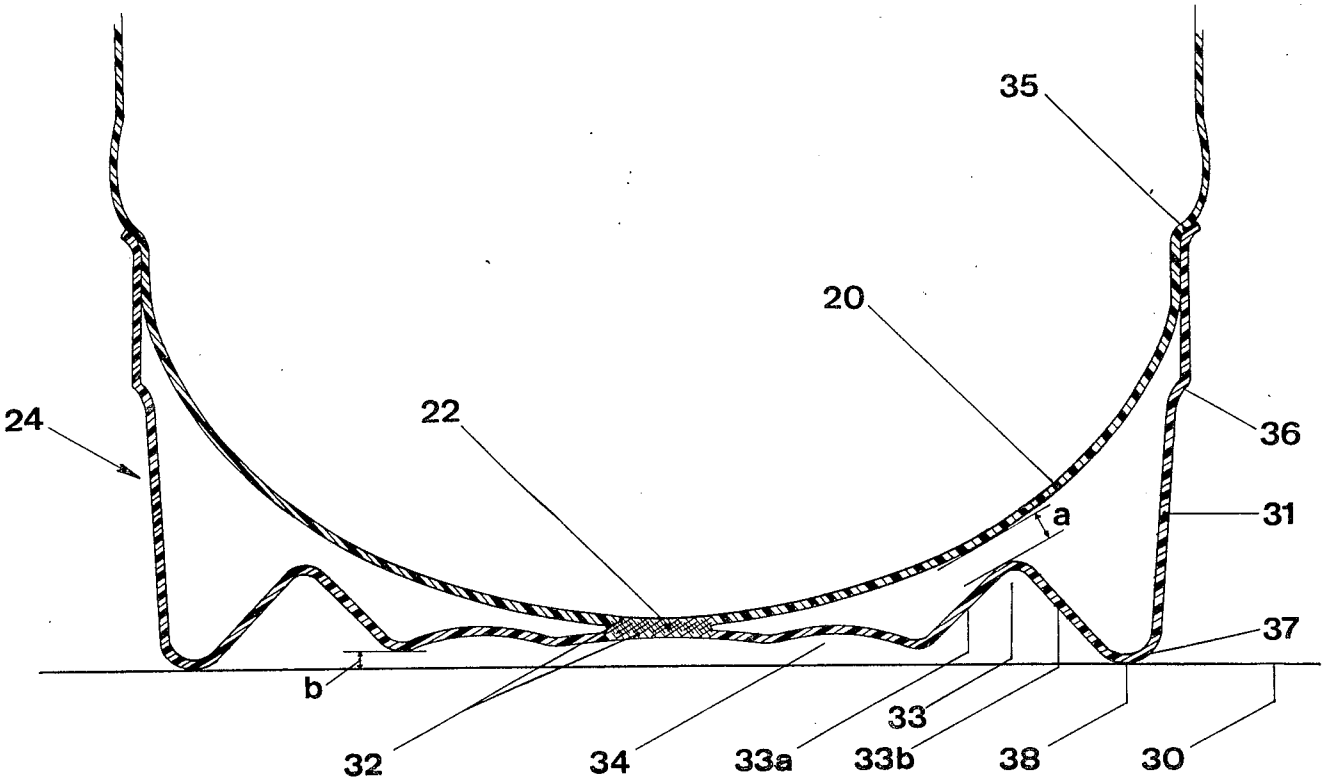
FIG. 3 is an enlarged cross-section through the stand and the bottom of the container body after the stand has been welded to the container body.

A container body 20 of plastic material produced by a blowing operation has a convex bottom section which projects into a stand 24. The stand is also of plastic material, preferably of recycled plastic material. Only the central zones 32 of the container body and the stand are jointed to each other by a suitable welding procedure, e.g. by ultrasonic welding. To ensure that, after welding, the stand 24 will be kept in contact along an annular shoulder 35 in the container body 20, the stand must have elastic properties. This is achieved by providing the stand 24 with a certain initial shape before welding as shown in FIG. 2, and pressing its central zone during welding towards the container body 20 so that it assumes its final shape, with internal stresses in the material. The higher the elasticity of the stand, the lower the pressure during welding and the more uniform will be the contact pressure, from one container to the next, at the area where the stand engages the container body. This is of great importance in ensuring consistent stability. The stand 24 includes a conical collar 31 which starts with a slight taper of about 0.5° near the annular shoulder 35 and then, after a shoulder 36, changes over to a taper of about 3.5°. After a curvature 37, the conical collar changes over to an annular support surface 38. This support surface 38 is followed, in a radial direction inwards, by at least one concentric, elastic indentation 33 extending around the container axis. This elastic indentation preferably comprises two conical surfaces 33*a*, 33*b* which slope at an angle of about 90° in relation to each other and a slope of about 45° in relation to the container axis. A distance "a" is provided between the first elastic indentation 33 and the container body 20, and this distance is adjusted to suit the weight of the container when filled. This distance is larger for high full weights and smaller for low full weights of the entirely filled container, and is consequently dependent on the density of the liquid in the container and also on the pressure in the container, since this pressure extends the container body slightly. The distance "a" prevents contact between the container body 20 and the elastic part of the stand, as long as the container is not subjected to abnormal loading or deformation. The elastic indentation only offers additional support in the event of overloading. The first indentation 33 is followed, in a direction towards the central zone, by a second indentation 34 which, with an arched cross-section, is also elastic and the radial limit of which is located at a distance "b" above the support plane. In the event of axial deformation, e.g. if the container is dropped heavily in a vertical direction onto a supporting surface 30, the shock will be arrested until the outer radial limit of the second elastic indentation 34 comes into contact with the supporting surface. In the zone "b", the level differences between the annular support surface 38 and the central zones 32 reserved for welding will also be equalized, so that satisfactory load distribution, suited to the container weight, will always occur at the surfaces which are decisive to the stability of the container.

The construction described is of particular importance in the event of an accidental fall of the container from a great height. If this results in an axial shock by impact against the opening or container bottom, the elastic indentations will always have the opportunity to arrest the deformations of the container body on all occasions, even when the elasticity of the indentations is reduced by contact against the container body and the indentations will also have the opportunity to ensure that the deformations will revert to their original shape, thus insuring that the container will remain upright in relation to the surface 30 supporting it. Due to the fact that the first indentation 33 provides elastic arresting of the container body 20 after the distance "a" is taken up, sufficient security is provided for the stand to resume to its original shape and for the container remain upright, even if impact is applied eccentrically in relation to the axis of the container.

Stands available so far have not been able to provide elastic, deformation-absorbing properties, whereas the distance "a", together with the weld 22, allow for complete, elastic arresting of the container body, and two or more elastic zones will then be active radially as well as axially.

The above description states that the stand is welded to the central bottom zone of the container body. However, the invention is not restricted to this method of fixing and also embraces other methods of fixing, such as gluing or riveting.

What is claimed is:

1. A composite container comprising an elongted container body of a plastic material having a convex bottom section and an annular shoulder means, and a stand of a plastic material supporting the container in a vertical position, said stand including a conical collar with an upper edge surface which is in contact with and surrounds said annular shoulder means, an annular support having a contact surface disposed in a plane and adapted for resting on a planar surface and an inner wall enclosed by said conical collar and extending inwardly from said annular support and means securing the container body and stand to each other in a central zone of the convex bottom section of the container body and said inner wall of said stand, said zone being positioned in a plane above the plane of said annular support on the planar surface, said inner wall comprising a first annular conical wall portion extending axially upwards and radially inwardly from said annular support, a second annular conical wall portion extending radially inwardly and axially downwards from said first conical wall portion, said first and second conical wall portions having an annular intersection zone which faces and is axially spaced from said convex bottom section of said container body, said first and second conical wall portions and said annular intersection zone forming a first elastic indentation means concentric with the axis of the container and spaced from said convex bottom section predetermined distance adjusted to the full weight of the container body for contacting said container body, upon relative movement between said container body and said stand, to undergo elastic deformation, said inner wall further comprising a third annular wall portion extending axially upwardly and radially inwards from said second wall portion, said second and third wall portions having an annular intersection zone which faces and is axially spaced from said plane of the annular support, said second and third wall portions and said annular intersection zone thereof forming a second elastic indentation means for contacting the planar support surface upon relative movement between said stand and said support surface to undergo elastic deformation, and a fourth wall portion extending radially inwards from said third annular wall portion and including the central zone of said stand, said container body and stand being in contact only in said central zone and at said annular shoulder means and the upper edge surface of the conical collar, the stand and container being elsewhere in spaced relation including the first, second, and third wall portions and the conical collar below said upper edge surface.

2. A composite container as claimed in claim 1 wherein said annular intersection zone between said first and second conical wall portions and said intersection zone between said second and third wall portions are respectively of rounded cross-section.

3. A composite container as claimed in claim 1 wherein the axial spacing between said annular intersection zone of said first and second conical wall portions and said bottom section of said container body is greater than the axial spacing between said annular intersection zone of said second and third wall portions and said plane of the contact surfaces of said annular support.

4. A composite container as claimed in claim 1 wherein said stand is in elastically stressed condition.

5. A composite container as claimed in claim 1 wherein said central zone of the stand has a diameter of about 25% of the diameter of the container body and the first elastic indentation means has an outside diameter of about 90% of the diameter of the container body.

6. A composite container as claimed in claim 1 wherein said first and second conical wall portions are inclined at an angle of 90% in relation to each other and at an angle of 45° in relation to the axis of the container.

7. A composite container as claimed in claim 1 wherein said conical collar of the stand extends downwardly with a relatively slight taper from said upper edge surface in a first section and thereafter extends downwardly at a greater taper.

8. A composite container as claimed in claim 7 comprising an annular shoulder dividing said first and second sections of said conical collar.

9. A composite container as claimed in claim 8 wherein the taper of said first section is 0.5° and the taper of said second section is 3.5°.

* * * * *